United States Patent [19]

Conlon et al.

[11] Patent Number: 5,000,331

[45] Date of Patent: Mar. 19, 1991

[54] STABILIZED BOTTLE

[75] Inventors: Daniel R. Conlon, Jenkintown; David S. Marston, Wyncote, both of Pa.

[73] Assignee: Instruments For Research and Industry I²R. Inc., Cheltenham, Pa.

[21] Appl. No.: 468,848

[22] Filed: Jan. 23, 1990

Related U.S. Application Data

[63] Continuation-in-part of Ser. No. 319,097, Mar. 6, 1987, abandoned, Continuation-in-part of Ser. No. 434,315, Nov. 13, 1989, abandoned.

[51] Int. Cl.[5] ..... B01L 3/00; B01L 9/00; B65D 23/00

[52] U.S. Cl. ..... 215/100 R; 215/1 C; 215/12.1; 248/364; 248/910; 422/104

[58] Field of Search ..... 215/100 R, 100.5, 247, 215/DIG. 3, 1 C, 12.1; 248/910; 206/438; 422/104

[56] References Cited

U.S. PATENT DOCUMENTS

| | | | |
|---|---|---|---|
| 95,088 | 12/1868 | Griswold | 215/100 R X |
| 1,468,429 | 9/1923 | Wixson | 16/216 X |
| 1,974,246 | 9/1934 | Littell | 248/910 X |
| 2,570,954 | 10/1951 | Kasman | 215/100.5 |
| 2,629,379 | 2/1953 | Fields | 215/247 X |
| 2,731,056 | 1/1956 | Anson | 215/100.5 X |
| 2,734,649 | 2/1956 | Callahan et al. | 215/DIG. 3 X |
| 2,923,427 | 2/1960 | Klopfenstein | 215/247 X |
| 3,089,606 | 5/1963 | Rothstein | 215/100 R |
| 3,330,281 | 7/1967 | Visser | 215/247 X |
| 3,461,728 | 8/1969 | Paoli | 215/100 R X |
| 3,969,080 | 7/1976 | Conlon | 248/910 X |
| 4,265,242 | 5/1981 | Cohen | 215/247 X |
| 4,398,643 | 8/1983 | Conlon | 215/100 R |
| 4,463,860 | 8/1984 | Yoshino et al. | 215/100 R |

FOREIGN PATENT DOCUMENTS

| | | | |
|---|---|---|---|
| 1327856 | 4/1963 | France | 215/100 R |

*Primary Examiner*—Sue A. Weaver
*Attorney, Agent, or Firm*—Paul Lipsitz

[57] ABSTRACT

A light-weight bottle stabilized against knockdown or tipping over comprising in combination, the bottle and a lead weight which weight is wrapped around the base of the bottle and wherein at least the surface contacting the bottle is covered with a cushioning material.

22 Claims, 9 Drawing Sheets

STABILIZED BOTTLE

This application is a continuation-in-part of application Ser. No. 07/319,097, filed in the name of Daniel R. Conlon on Mar. 6, 1987, and of application Ser. No. 07/434,315, filed in the name of David S. Marston on Nov. 13, 1989, and both abandoned.

This invention relates to a bottle or a bottle-like object stabilized against accidental knockdown by a particularly designed lead weight.

BACKGROUND OF THE INVENTION

Bottles or similar objects made of light-weight polymeric materials such as polyethylene and polypropylene find common use in laboratories. A particular application of such bottles is in their use in laboratories such as chemical and biological analysis where the top of the bottle is often fitted with a burette, a pipette or other tall apparatus. Because the bottle is light in weight such an arrangement results in an unstable apparatus which is often tipped over by accidental contact of a hand or an elbow with the burette or pipette. Similarly, certain filter apparatus have a bottle-like base and are also unstable and are easily tipped over a pulled over by a vacuum hose attached to the bottle. Also, bottles of this type, even without appendages, are often tipped over.

It is an object of this invention to provide a light-weight bottle such as those described above in combination with a specially designed weight to obviate the instability inherent therein.

DISCUSSION OF THE PRIOR ART

It is known in the art to stabilize laboratory flasks, measuring cylinders, and the like with lead weights. For example, U.S. Pat. No. 3,696,080 discloses the use of a cut torus covered with a cushioning material to stablize erlenmeyer flasks and narrow measuring cylinders by being placed over the neck of or around the base of the cylinder. U.S. Pat. No. 4,398,643 also discloses a flexible, star-shaped lead weight which is placed over the neck of flasks to stabilize laboratory ware.

However, these weights of prior art do not lend themselves to use on conventional bottles since they cannot be manipulated to fit around the bottle and hold the bottle in contact with the weight.

BRIEF DESCRIPTION OF THE INVENTION

This invention provides in combination, a light-weight bottle and a stabilizing weight wherein the weight comprises a length of lead or other heavy, but flexible, material bent around the base of the bottle, the lead being covered or coated with a cushioning material. In one embodiment, the lead weight will have on one side thereof a plurality of contact surfaces which result from the bending of a length of lead which has spaced apart notches perpendicular to the longest dimension of the lead, said weight being covered or coated with a cushioning material and wrapped around the base of the bottle so that the protuberances or notched side is adjacent to the surface of the bottle. Because of the ease of manufacture, the notched weight is often a preferred embodiment of the invention.

In another embodiment, the invention provides, in combination, a light-weight bottle and stabilizing weight wherein a heavy, bendable, polysided, encircling band, said weight being covered or coated with a cushioning material, and the weight surrounds the base of the bottle to make contact with the bottle.

DETAILED DESCRIPTION OF THE INVENTION

Figure 1:
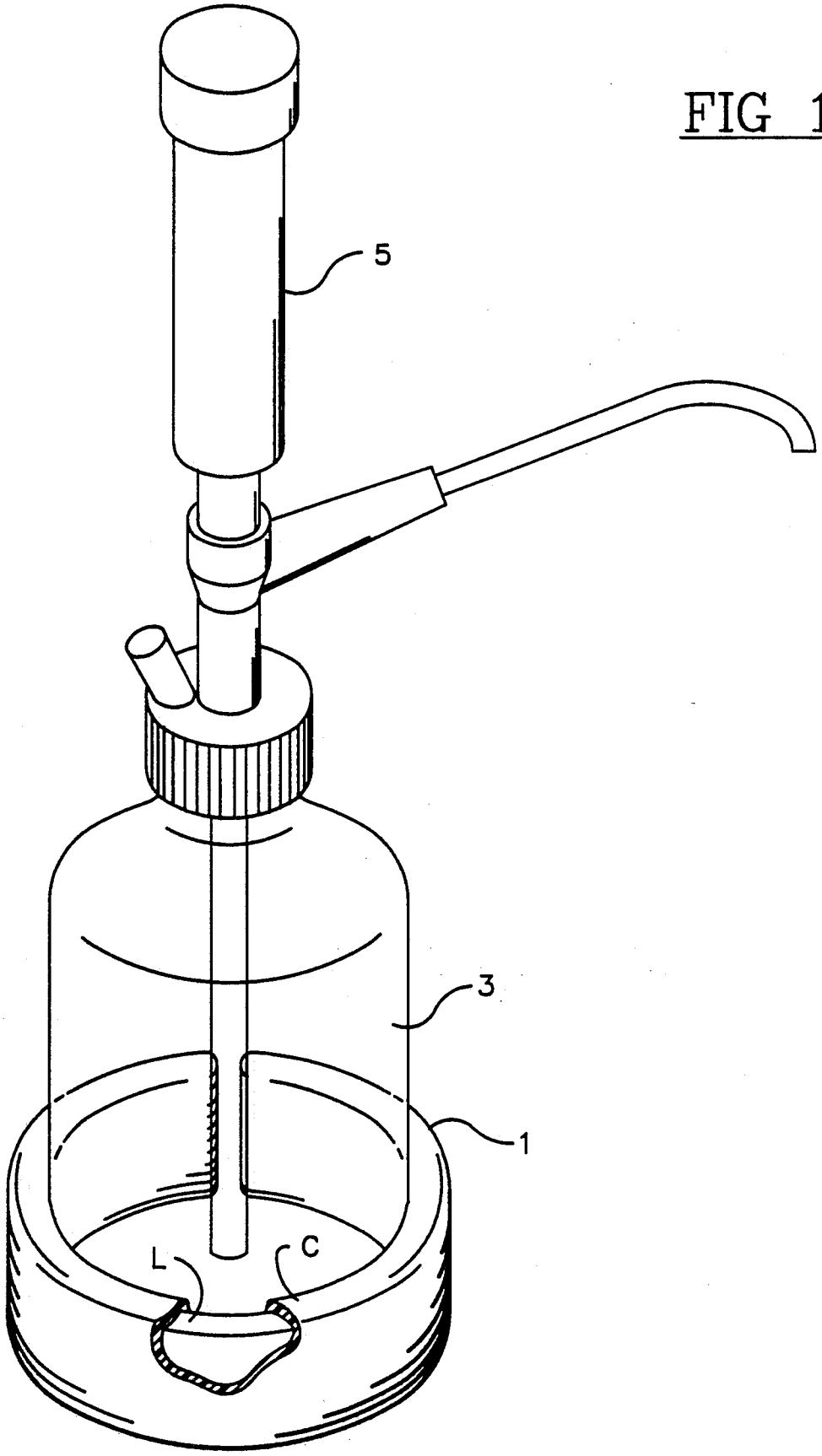
FIG. 1 is a perspective view of the invention showing the weight encircling the base of a bottle.

Referring to FIG. 1, a band of lead L covered with cushioning material C comprises the weight shown generally as 1. The weight 1 encircles a bottle 3 at its base, the bottle being fitted with a dispensing device 5.

Figure 2:
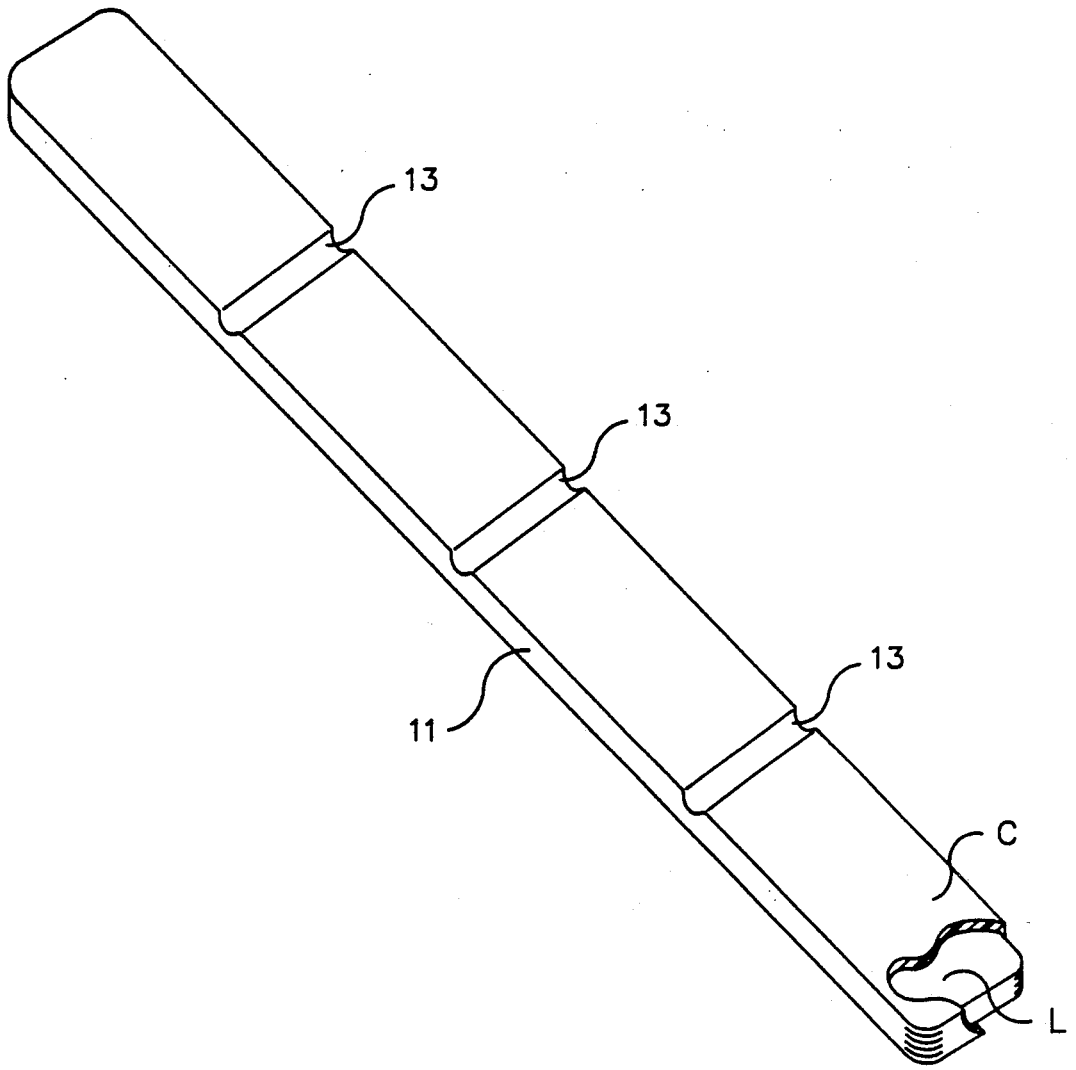
FIG. 2 is a perspective view of the length of lead showing a plurality of notches on one side thereof.

Referring now to another embodiment of the invention in FIG. 2, a length of heavy, flexible material, illustrated herein as lead L, covered with a cushioning material C such as polyvinylchloride is shown generally as 11. Perpendicular to the longest dimension of the lead length are a plurality of notches 13 which are shown as essentially evenly spaced from each other. The actual dimensions of the length of lead and the number of notches will, of course, depend upon the diameter of the bottle with which it will be used. For example, for a bottle having a diameter of about three inches, the length of lead will be about nine or ten inches long, about one to two inches wide, about one-eighth to about one-half inch thick, and will have at least about three notches. The number of notches is not critical and may vary from several to many and may, in fact, be so numerous as to give the weight a toothed or an essentially serrated face. The lead weight is readily fabricated by casting, extrusion or other methods, but, for economy, may be extruded from an appropriate die and cut into lengths of appropriate width, which lengths are then coated with the desired cushioning material. It will be understood that, although it is preferred to cost all surfaces of the lead weight, the cushioning material may be applied only to the surface which will come in contact with the bottle. Thus, an appropriate strip of cushioning material (e.g., a foam strip) may be adhered to the longest dimension of the lead length with all or some of the other lead surfaces uncoated.

In use, the length of coated lead as shown in FIG. 2 is simply bent around the base of the bottle and the notches beneficially contribute in three ways:

(1) They aid in bending the weight around the bottle.

(2) They create a plurality of vertical surfaces in contact with the side of the bottle so that the bottle is tightly held by the weight. This good contact would not occur in the absence of the notches.

(3) The cushioning material, particularly, polyvinylchloride, makes a good, non-slip contact with the bottle.

Figure 3:
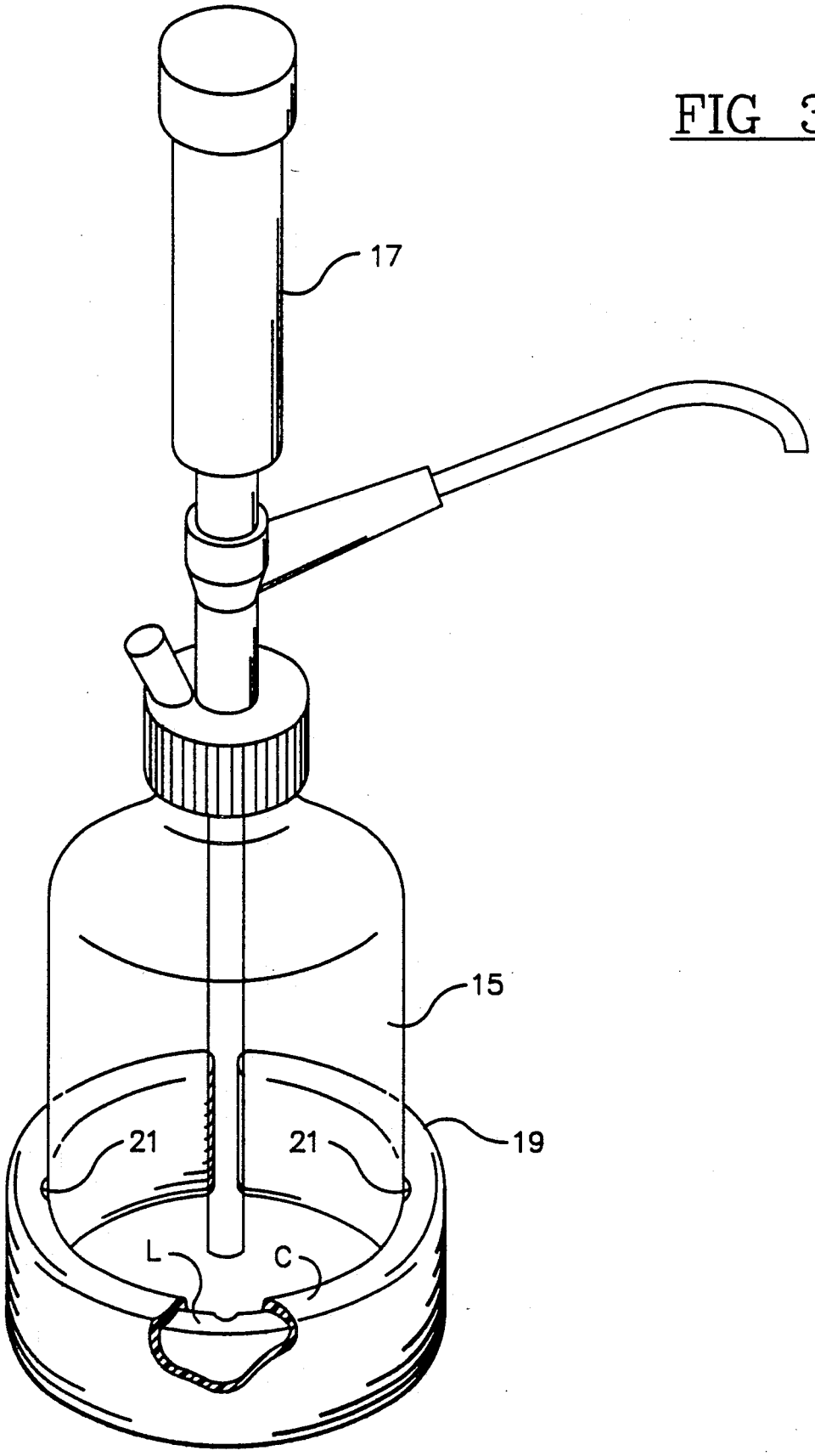
FIG. 3 and FIG. 4 illustrate preferred embodiments of the invention.

FIG. 3 illustrates in more detail how the weight surrounds and holds the base of the bottle. As shown in FIG. 3, the bottle 15 has affixed to its neck opening a vertical apparatus, which is in this instance, is a fixed volume dispenser shown generally as 17, which illustrates how the bottle might be used in a chemical or biological laboratory. At the base of the bottle, the lead stabilizing weight 19 with notches 21 is wrapped around the bottle and thereby imparts stability to the system so as to prevent easy knockover.

Figure 4:
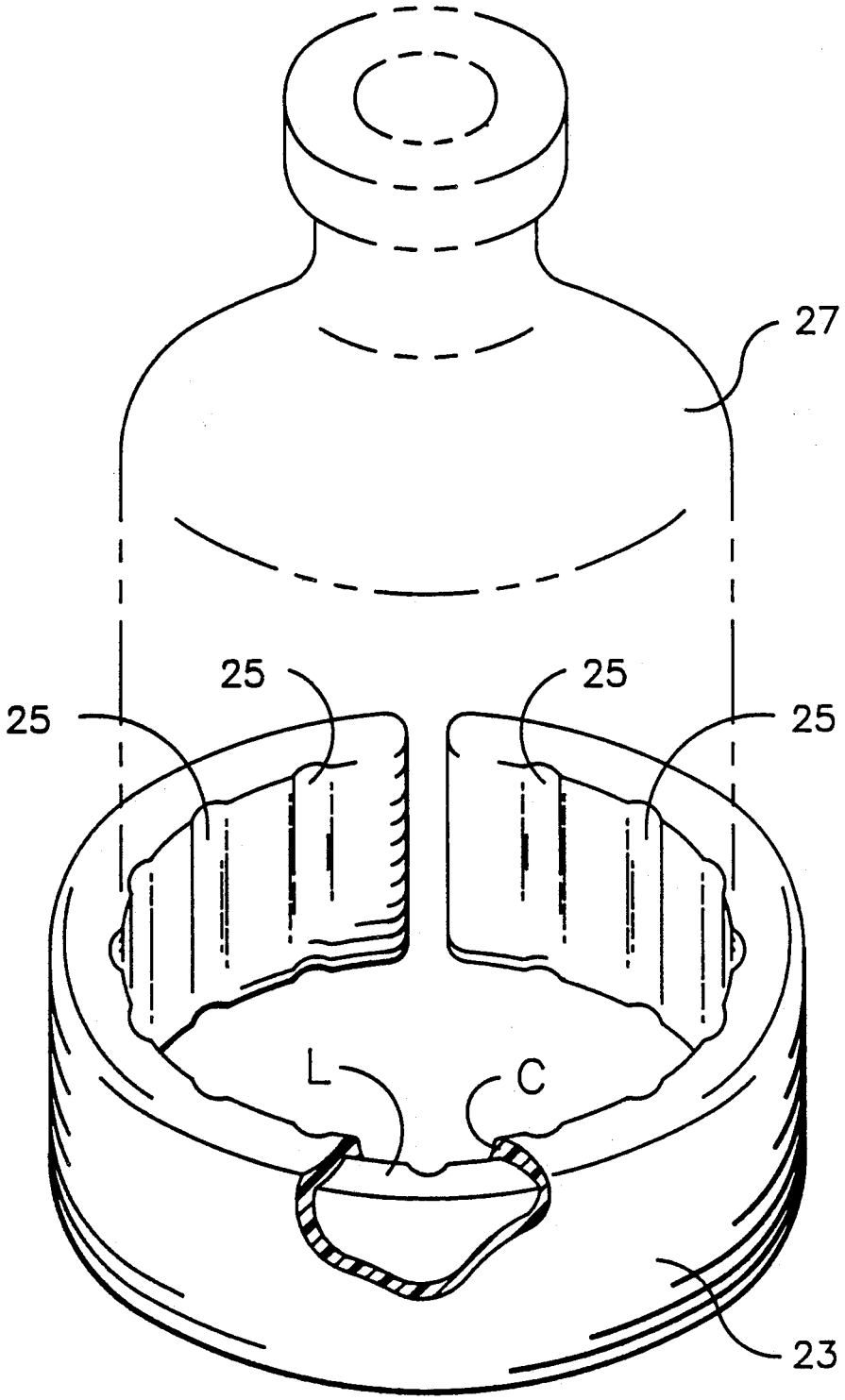

FIG. 4 shows the embodiment of the invention where the weight 23 has numerous notches 25, the bottle 27 being shown in phantom lines. Also shown in FIG. 3 is a preferred embodiment of using the weight in that the ends of the weight are not abutted, but have a space between them. This space permits viewing into the bottle to determine the height of the liquid present.

Figure 5:
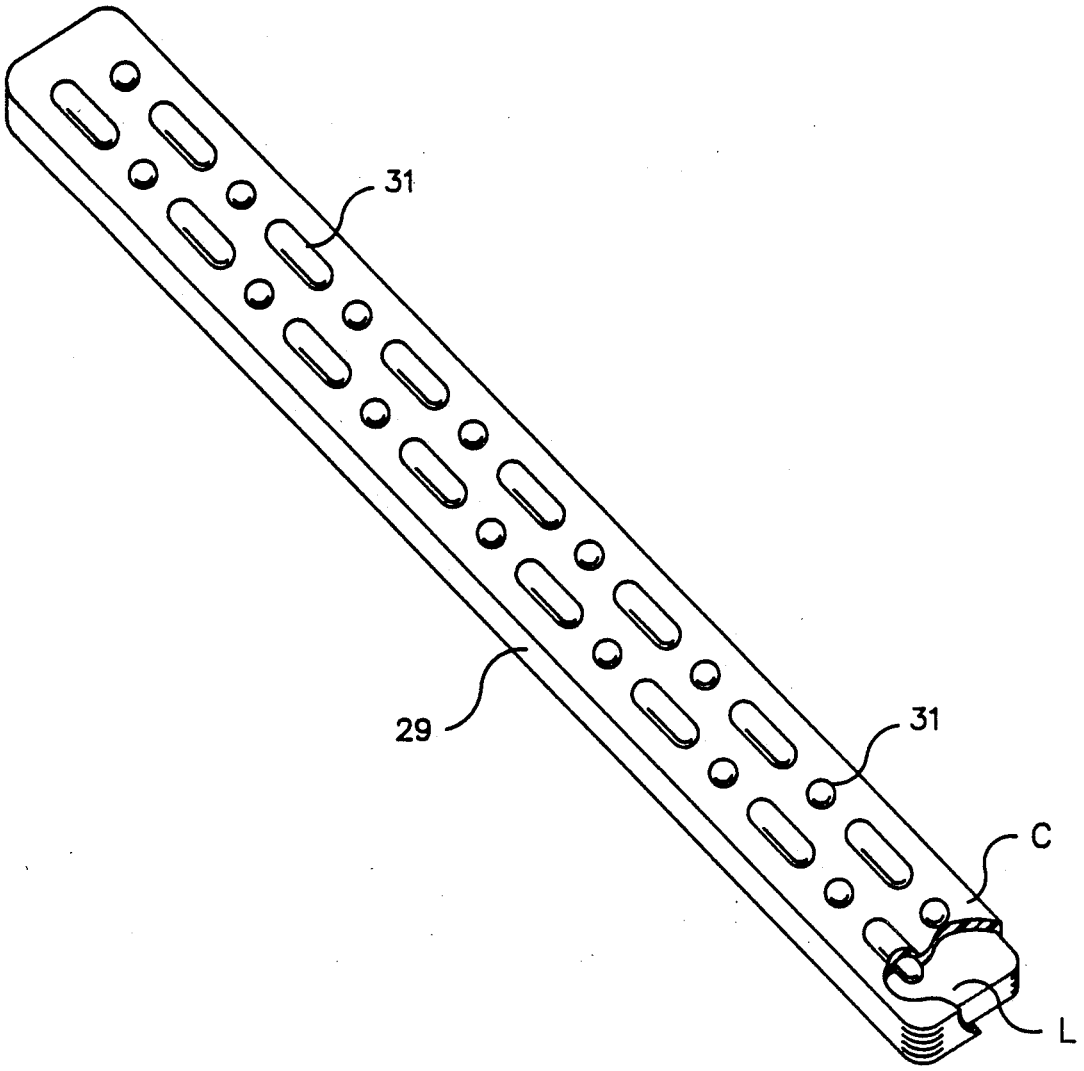
FIG. 5 illustrates the invention using a weight having surface protuberances.

FIG. 5 shows the embodiment of the invention wherein the weight 29 has surface protuberances 31 which are put in contact with the outside surface of the bottle by wrapping the weight around the bottle or like device. The weight 29 having the protuberances as shown may be readily manufactured by casting an appropriate bar with the protuberances and then coating the bar with the cushioning material. Where the stabilizing weight is of the embodiment shown in FIG. 4, having a plurality of protuberances, a plurality of notches may also be present as an aid to bending the bar around the bottle or other device.

Figure 6:
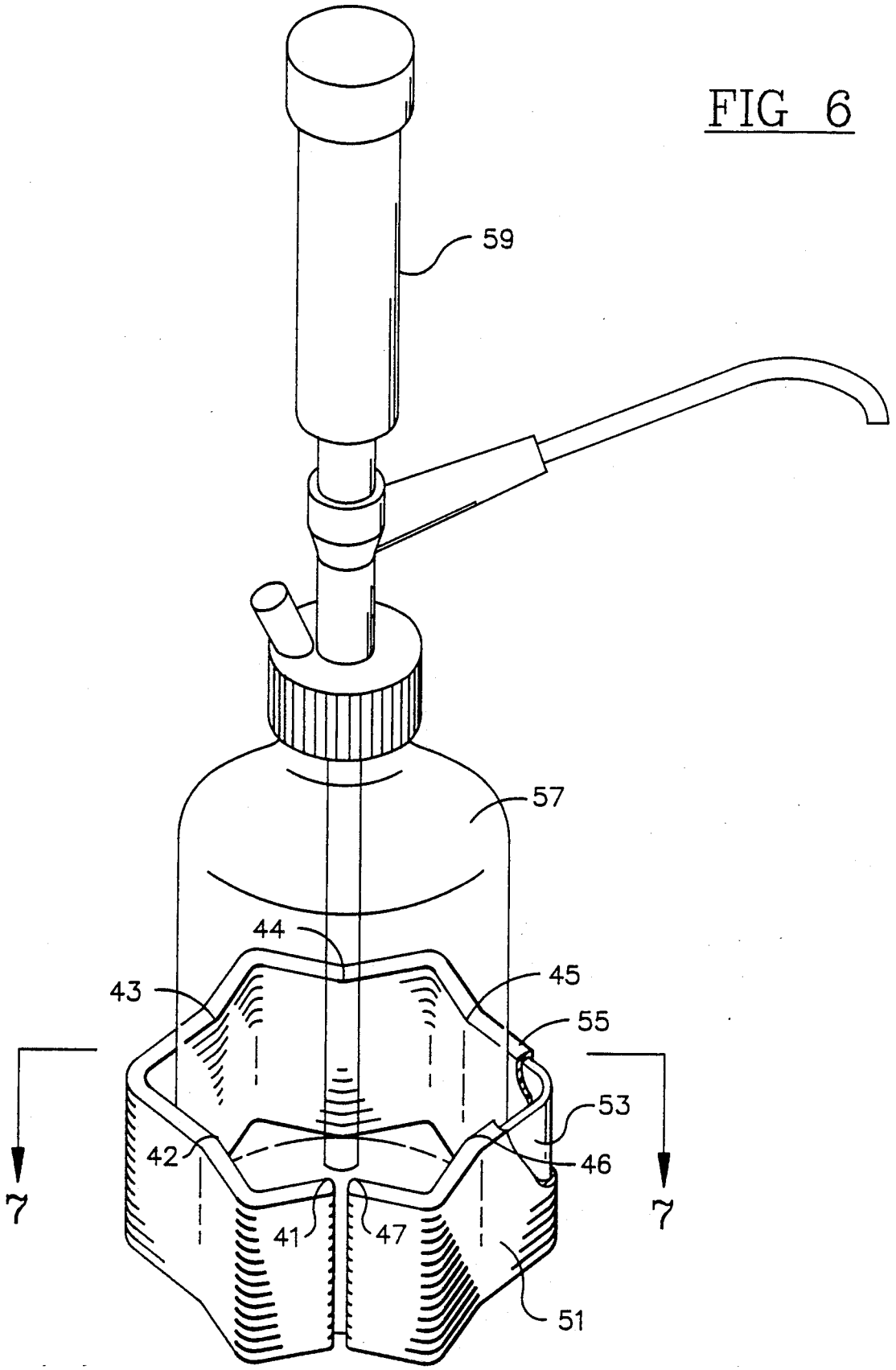
FIG. 6 is a perspective view of a star-shaped weight surrounding the base of a dispensing bottle.
Figure 7:
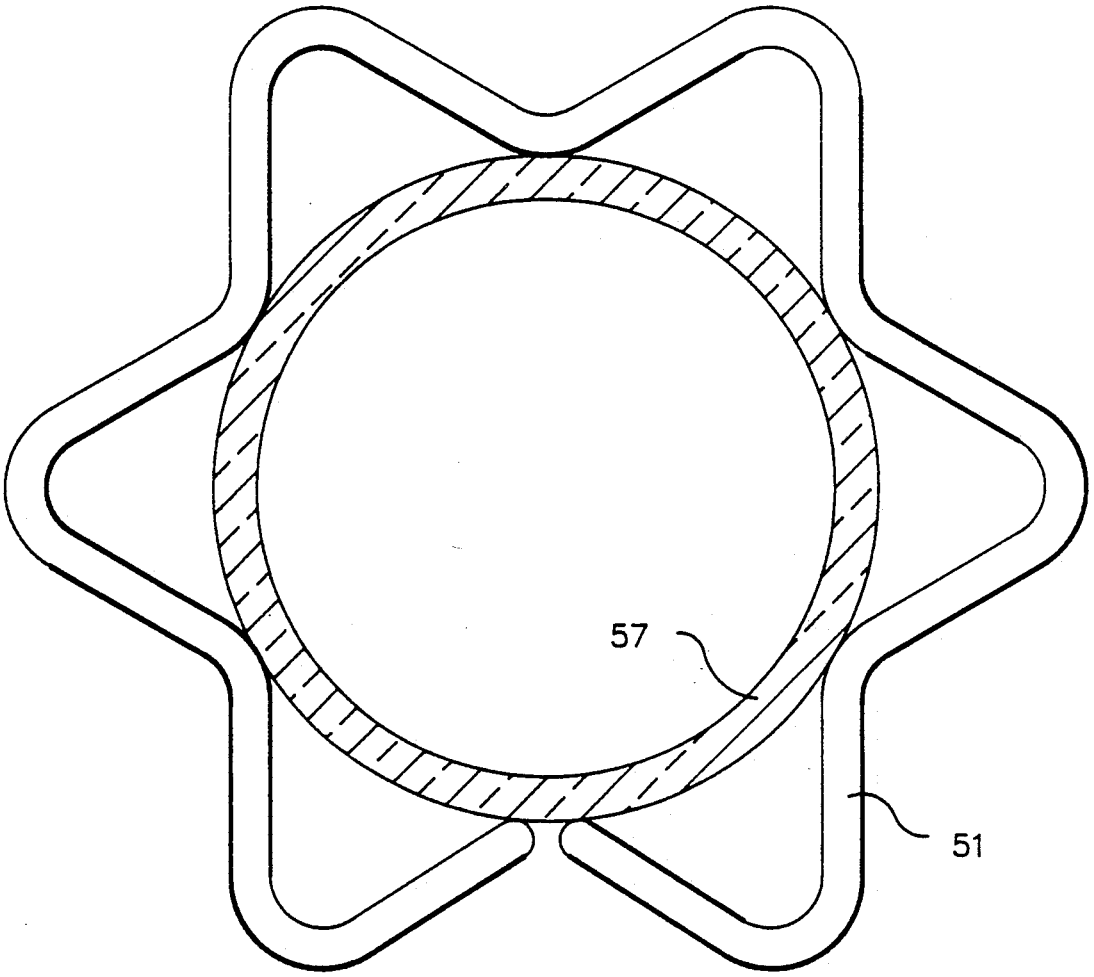
FIG. 7 is a cross-sectional view taken along line 7—7 of FIG. 6 showing the weight around the bottle.

Referring now to FIG. 6, the weight shown generally as 51 comprises a band of heavy, bendable material, illustrated herein as a length of lead 53, covered with a cushioning material 55 such as polyvinylchloride. The lead band 51 shown in the drawing is essentially star-shaped in cross-section and surrounds a bottle 57 which bottle is fitted through its top opening with a fixed volume dispensing unit 59 illustrating how the stabilized bottle may be used in a chemical or biological laboratory. FIG. 7, taken along line 7—7 of FIG. 6, shows in cross-section how the star-shaped weight may contact the sides of the bottle 57. In the absence of the heavy weight 51, the bottle is tipsy and easily upset. With the weight encircling and contacting the base of the bottle, however, the bottle is stabilized against tip-over.

Figure 8:
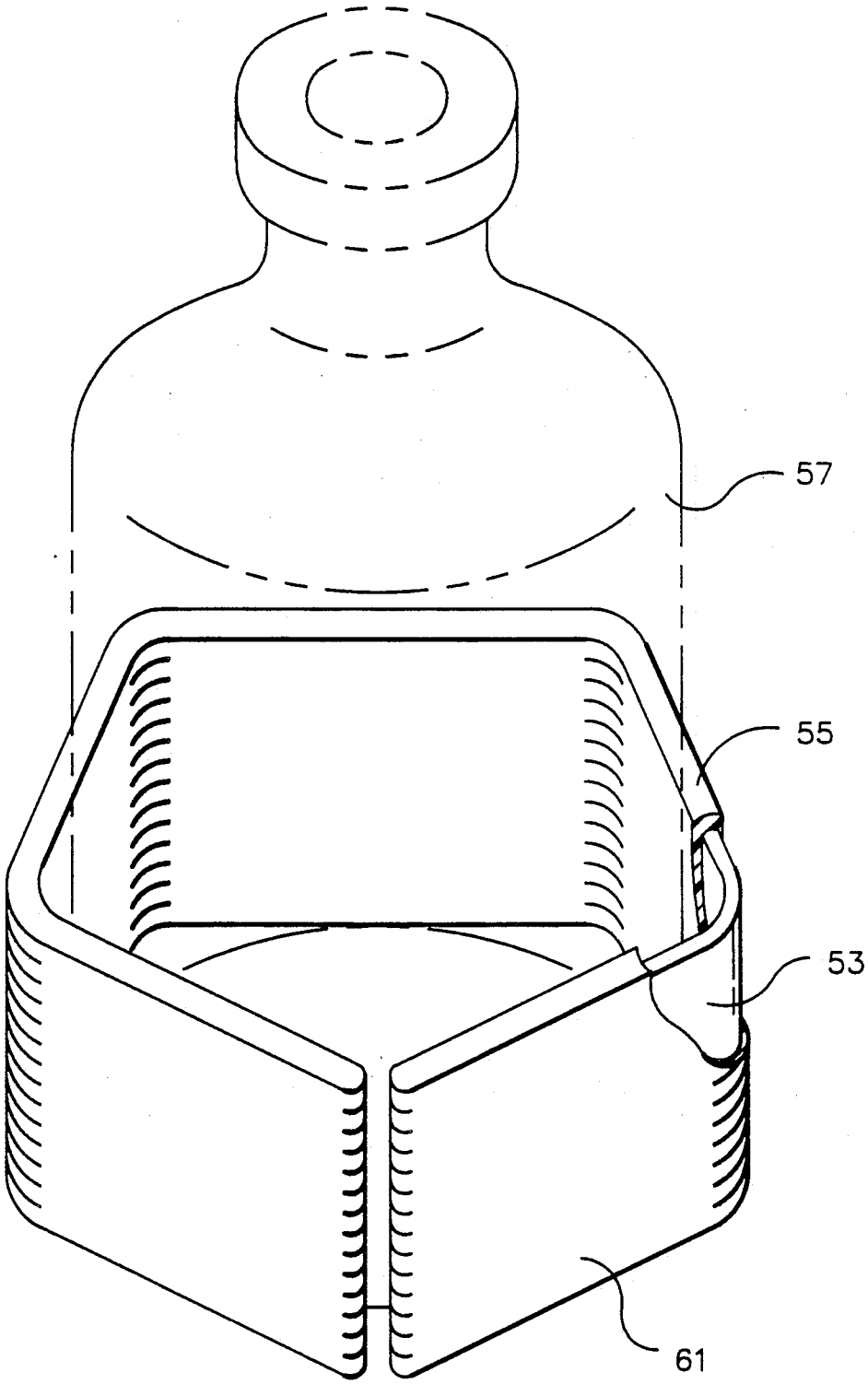
FIGS. 8 and 9 shows perspective views of alternative embodiments of the weights used.
Figure 9:
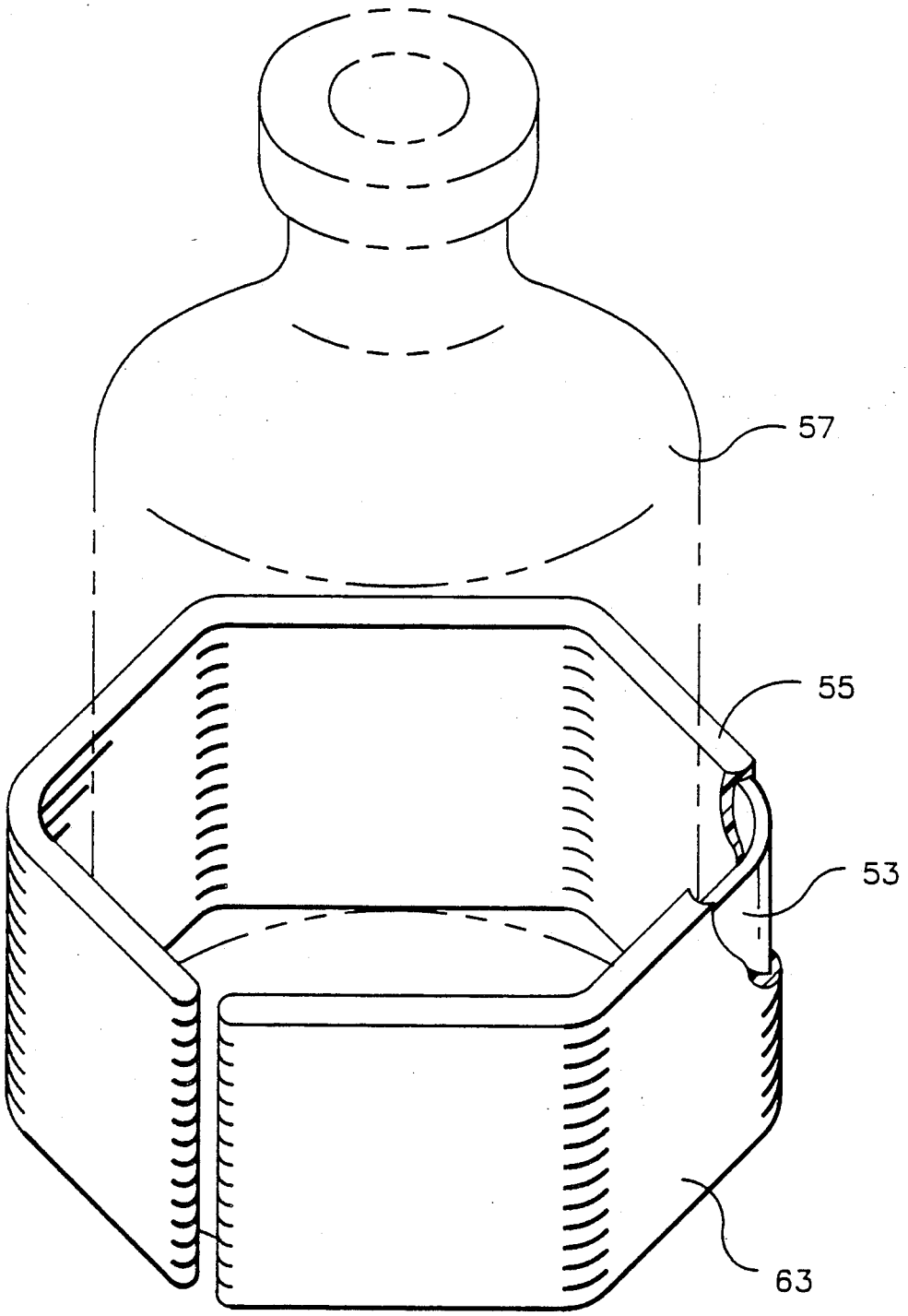

The heavy, bendable band is preferably made of lead and is easily shaped from a flat lead strip of appropriate dimensions. It will be understood that the bendable, polysided weight, which encircles the base of the bottle, may have a variety of cross-sectioned shapes. FIG. 8 illustrates a weight of lead 53 having five sides shown generally as 61, surrounding a bottle 57 shown in phantom. Cushioning material 55 covers the lead 53. FIG. 9 shows a six-sided weight shown generally as 63 encircling a bottle 57. As in the other figures, a cushioning material 55 covers the lead 53. Other shaped weights, such as three, four, and seven-sided octagonal weights, may also be employed.

It is desirable that the weight be bent around the bottle and squeezed so as to make partial contact with the vertical surface of the bottle. Such contact with the weight enables a non-slip control between the bottle and the cushioning material of the weight to be achieved and this ensures stability. However, stability of the bottle is also achieved when the weight around the bottle is merely in close proximity to the vertical surface of the bottle, but is not actually touching the bottle's surface, because the height of the weight is sufficient to keep the bottle from tipping over. Thus, when the weight is used without contacting the bottle's surface, the height of the weight should be about one-fourth to about one-third of the height of the bottle. Under such conditions, the bottle may be readily lifted from the encircling weight, but while the weight surrounds it the bottle will not tip over if the bottle or any apparatus attached to it is accidentally hit or pulled in a sideways manner. Preferably, however, the encircling weight will be squeezed sufficiently so as to make contact with the bottle.

Manufacture of the various weights used in the invention is within the skill of the art. The star-shaped weight may be readily formed by passing a lead strip through appropriate toothed gears having appropriate clearance for the thickness of the strip. The weight shown in FIG. 1 and the polysided weights are easily formed by bending a lead strip around a mandrel of appropriate size and shape. The lead strips for the weights may be made by extruding lead from a die of appropriate shape and cutting the extruded length to the desired size. Other manufacturing techniques will be evident to those skilled in the art. The weight is costed with the cushioning material after it is shaped, but it will be understood that, although it is preferred to coat all surfaces of the lead weight, the cushioning material may be applied only to the surface which will come in contact with the bottle. Thus, an appropriate cushioning material (e.g., a coating or foam strip) may be adhered to the inside surface of the lead band with some of the lead surfaces uncoated.

Referring to the star-shaped weight shown in FIG. 6, the actual dimension of the encircling band and the number of points of the star shape may vary, but the weight should have at least three, and preferably, five or more points adjacent the bottle which is shown in FIG. 6 by the numerals 41 to 47 at the upper plane of the weight. By way of illustration, for stabilizing a bottle having a base diameter of about two inches, a weight will be made from a lead strip having a length of about ten inches and a thickness of about one-sixteenth inch.

A particular advantage of the star-shaped weight is that it is simple to use and by placing it around the base of the bottle and squeezing slightly, it makes positive, essentially non-slipping, partial contact with the bottle in at least two places, thus holding it and ensuring stability. The weight of the invention is particularly useful with flexible or compressible bottles such as those made of polyethylene, polypropylene, and the like, but is also useful with bottles made of rigid materials such as glass, polystyrene, polycarbonate, and the like.

It will be noted that the ends of the weight encircling the bottle do not quite meet, thus leaving a space which is often helpful in enabling the height of liquid in the bottle to be visually determined. Also, the fact that the ends of the weight do not meet enables the band to be adjusted somewhat to fit bottles having various diameters, thus one weight can accommodate a range of bottle sizes.

It will be understood that numerous changes and variations from the above description may be made without departing from the scope of the invention.

We claim:

1. A light-weight bottle or similar device stabilized against tipping over, comprising in combination a light-weight bottle having vertical sides in contact with a stabilizing weight, said weight comprising a length of heavy, flexible material having on one side thereof a plurality of contact surfaces, said weight being covered on at least its longest dimension with a cushioning material to make contact with said bottle and said weight being bent around the base of said bottle so that the contact surfaces are adjacent to the surface of the bottle.

2. The combination of claim 1 wherein the weight is made of lead and the contact surfaces are protuberances on the lead weight.

3. The combination of claim 2 wherein the bottle contains an apparatus inserted through a top neck opening of the bottle.

4. The combination of claim 1 wherein said plurality of contact surfaces are defined by small protuberances on said weight.

5. A light-weight bottle or similar device stabilized against tipping over, comprising in combination a light-weight bottle having vertical sides and a stabilizing weight, said weight comprising a length of lead having on one side thereof a plurality of spaced apart notches perpendicular to the longest dimension of said lead, said weight being coated with a cushioning material to make contact with said bottle and bent around the base of said bottle so that the notched surface is adjacent to the surface of the bottle.

6. The combination of claim 5 wherein the notches in the lead are essentially evenly spaced apart.

7. The combination of claim 5 wherein the length of lead is serrated to define said notches.

8. A light-weight bottle or similar device stabilized against tipping over, comprising in combination a light-weight bottle having vertical sides and a stabilizing weight, said weight comprising a length of heavy, flexible material having on one side thereof a plurality of contact surfaces, said weight being covered on at least its longest dimension with a cushioning means to make non-slip contact with said bottle and said weight being bent around the base of said bottle so that the contact surfaces are adjacent to the surface of the bottle.

9. The combination of claim 8 wherein the bottle is polyethylene or polypropylene.

10. The combination of claim 9 wherein the bottle contains an apparatus inserted through a top neck opening of the bottle.

11. A light-weight bottle or similar device stabilized against tipping over, comprising in combination a light-weight bottle having vertical sides and a stabilizing weight, said weight comprising a length of lead having on one side thereof a plurality of spaced apart notches perpendicular to the longest dimension of said lead, said weight being coated with a cushioning means to make non-slip contact with said bottle and bent around the base of said bottle so that the notched surface is adjacent to the surface of the bottle.

12. The combination of claim 11 wherein the bottle is polyethylene or polypropylene.

13. The combination of claim 12 wherein the bottle contains an apparatus inserted through a top neck opening of the bottle.

14. A light-weight bottle or similar device stabilized against tipping over, comprising in combination a light-weight cylindrical bottle encircled in close proximity with a polysided stabilizing weight which weight comprises an upstanding band of heavy bendable material with flat side walls peripheral top and bottom edges and a pair of ends bounding said side walls, said band being covered with a cushioning material, which band is bent at an angle in at least two areas around the base of said bottle so as to define said polysided structure while said band rests on its bottom edge and to bring the ends of said weight in close proximity.

15. The combination of claim 14 wherein the weight is made of lead.

16. The combination of claim 15 wherein the bottle contains an apparatus in its neck.

17. The combination of claim 14 wherein the weight has from four to about eight sides.

18. The combination of claim 14 wherein the weight has five sides.

19. The combination of claim 14 wherein the weight has six sides.

20. A light-weight bottle or similar device stabilized against tipping over, comprising in combination a light-weight cylindrical bottle encircled with a stabilizing weight made of an essentially C-shaped band of lead with flat side walls, peripheral top and bottom edges and a pair of ends bounding said side walls, said weight being covered with a cushioning material and being bent at an angle in at least two areas around the base of said bottle so as to define said C-shape while said band rests on its edge and to bring the ends of said band in close proximity so that at least partial contact is made with the surface of the bottle.

21. A light-weight bottle or similar device stabilized against tipping over, comprising in combination a light-weight cylindrical bottle encircled with a stablizing weight, said weight comprising an upstanding lead band with flat side walls, peripheral top and bottom edges and ends bounding said side walls, said being bent at an angle in at least two areas to define a star-shaped cross-section, said band being coated with a cushioning material and bent around the base of said bottle so as to rest on its bottom edge and to bring the ends of said band in close proximity and to make partial contact with the surface of the bottle.

22. The combination of claim 21 wherein the bottle contains an apparatus in its neck.

* * * * *